United States Patent [19]

Takimoto

[11] 4,127,097

[45] Nov. 28, 1978

[54] FUEL EVAPORATION CONTROL SYSTEM

[75] Inventor: Masatami Takimoto, Toyota, Japan

[73] Assignee: Toyota Jidosha Kogyo Kabushiki Kaisha, Toyota, Japan

[21] Appl. No.: 801,797

[22] Filed: May 31, 1977

[30] Foreign Application Priority Data

Dec. 15, 1976 [JP] Japan ..... 51-149807

[51] Int. Cl.[2] ..... F02M 69/00

[52] U.S. Cl. ..... 123/136

[58] Field of Search ..... 123/121, 136

[56] References Cited

U.S. PATENT DOCUMENTS

| | | | |
|---|---|---|---|
| 3,935,850 | 2/1976 | King | 123/136 |
| 4,026,258 | 5/1977 | Ino et al. | 123/136 |

*Primary Examiner*—Charles J. Myhre
*Assistant Examiner*—Tony M. Argenbright
*Attorney, Agent, or Firm*—Stevens, Davis, Miller & Mosher

[57] ABSTRACT

A fuel evaporation control, or vapor recovery system including: a charcoal canister housing therein activated charcoal adapted to adsorb gasoline vapor from a fuel tank; a purge port leading to a canister and opening into an intake passage in such a position that a throttle valve for the carburetor may assume an upstream position and a downstream position relative to the purge port, depending on its open positions; and a valve for controlling communication between the charcoal canister and a portion of the intake manifold, which is downstream from the throttle valve, in response to the operational condition of the engine. This fuel evaporation control system allows the vapor from the fuel tank to pass into the engine during engine deceleration or when the engine is loaded over a given load level. This system, however, interrupts the supply of gasoline vapor to the engine, during engine idling or when the engine is lightly loaded. Because of the supply of gasoline vapor during engine deceleration, the charcoal canister may provide capacity enough to retain the gasoline vapor when the engine is loaded over a given load level so that the size of the canister need not be increased and the cleaning time of gasoline vapor with air through the canister may be shortened.

2 Claims, 12 Drawing Figures

FUEL EVAPORATION CONTROL SYSTEM

BACKGROUND OF THE INVENTION

1. Field of the Invention

This invention relates to a fuel evaporation control or vapor recovery system including a charcoal canister, and, more particularly, to a system of the type described, which allows the supply of gasoline vapor to pass to the engine during engine deceleration, thereby improving the efficiency of the charcoal canister.

2. Description of the Prior Art

A fuel evaporation control or vapor recovery system, which prevents the emission of gasoline vapor from the fuel tank into the atmosphere, having a charcoal canister having activated charcoal housed therein, is known. In the prior art fuel evaporation control system, gasoline vapor, which is accumulated or adsorbed within the charcoal canister, is supplied to an internal combustion engine under the following conditions: when the engine is loaded over a given load level; while the supply of gasoline vapor is interrupted; and when the engine is loaded below a given load level.

Recently, government regulations for controlling fuel evaportion from fuel tanks have become more strict, and hence it is desirable to improve the efficiency of charcoal canisters. According to the prior art, it is an easy task to provide systems, which may increase the amount of gasoline vapor to be supplied to an engine by increasing the size of the charcoal canister. However, the amount of oxygen in an exhaust system is limited in high load conditions, so that an increase in amount of gasoline vapor would lead to an increase in amount of harmful emission from an engine. An increase in size of the charcoal canister to offset this is not desirable from a design viewpoint.

Meanwhile, it has become common practice to use a secondary air supply means for an exhaust system for treating harmful constituents of exhaust gases (for instance, hydrocarbons and carbon monoxide). The secondary air is supplied to an exhaust system from an air pump or through a reed valve means, which operates in response to a variable vacuum in the exhaust manifold. Meanwhile, the concentration of oxygen contained in exhaust gases is relatively high, during engine deceleration or in a negative output condition of the engine. This discovery has been overlooked in solving the aforesaid problem.

SUMMARY OF THE INVENTION

It is, accordingly, an object of the present invention to provide a fuel evaporation control or vapor recovery system for use in an internal combustion engine, which allows the supply of gasoline vapor from a charcoal canister to pass to the engine during engine deceleration or when the engine remains in a negative output condition, thereby allowing the charcoal canister to retain a sufficient amount of gasoline vapor from the fuel tank, when the engine is loaded over a given load level, and hence improving the efficiency of the canister, without increasing the size thereof.

The present invention is based on the aforesaid discovery that the concentration of oxygen contained in exhaust gases is relatively high during engine deceleration and thus contemplates facilitating passage of the supply of gasoline vapor from the charcoal canister to the engine during engine deceleration.

According to the present invention, there is provided a fuel evaporation control system, which comprises: a charcoal canister containing activated charcoal adapted to adsorb gasoline vapor from a fuel tank; a purge port leading to the charcoal canister and opening into an intake passage in such a position that the throttle valve of the carburetor assumes an upstream position and a downstream position relative to the purge port, depending on its open positions; and a valve for controlling communication between the charcoal canister and a portion of the intake manifold which is downstream of the throttle valve, in response to the operational condition of the engine, thereby allowing the vapor from the fuel tank to flow into the engine, during engine deceleration or when the engine is loaded over a given load level, while the supply of vapor to the engine is interrupted, during engine idling or when the engine is lightly loaded.

DESCRIPTION OF THE PREFERRED EMBODIMENTS

Figure 1:
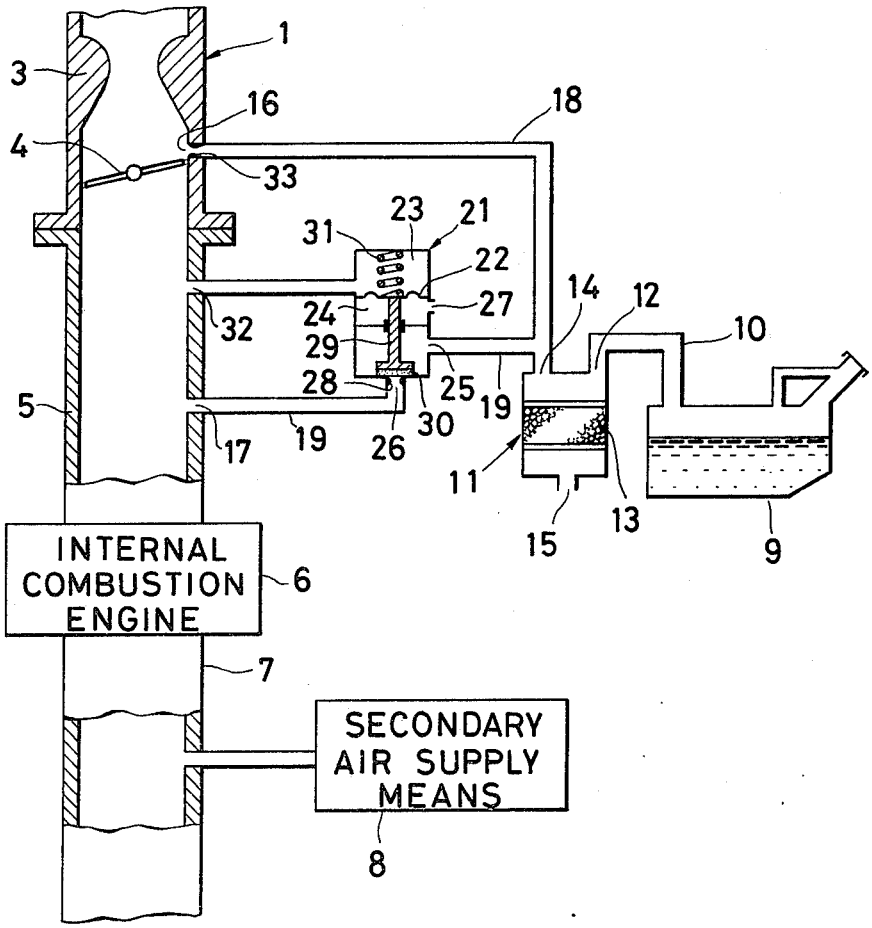
FIGS. 1 to 8 and FIGS. 11 and 12 are schematic views of the fuel evaporation control system embodying the present invention.

FIG. 1 shows the first embodiment of the fuel evaporation control system according to the present invention. A carburetor 1 is equipped with a venturi portion 3 and a throttle valve 4. Carburetor 1 is connected by way of an intake manifold 5 to an internal combustion engine 6. An exhaust manifold 7 is connected to internal combustion engine 6 downstream thereof, and a secondary air supply means 8 is connected to the exhaust manifold 7 for oxidation treatment of harmful emissions in the exhaust system. The space in fuel tank 9, which is filled with gasoline vapor communicates by way of vapor passage 10 to an inlet 12 of charcoal canister 11. Activated charcoal 13 is contained in the charcoal canister 11, and gasoline vapor from fuel tank 9 is adsorbed on the activated charcoal by being drawn through the vapor passage 10. Charcoal canister 11 is equipped with an outlet 14 and an opening 15 communicating with the atmosphere, in addition to inlet 12.

Positioned in close proximity to the throttle valve 4 of carburetor 1 in the wall of an intake passage is a purge port 16. When the throttle valve 4 is opened to an opening larger than a given opening A, throttle valve 4 assumes an upstream position relative to the purge port 16. An orifice 33 having an open cross-sectional area Q1 is provided in purge port 16. Another purge port 17 is provided in intake manifold 5 downstream from the first referred to purge port 16. The outlet 14 of charcoal canister 11 is connected by way of passage 18 to purge port 16. Outlet 14 is also connected to port 17 via passage 19. A vacuum responsive diaphragm control valve 21 is provided in passage 19 for opening and closing the passage 19. The interior of the vacuum responsive diaphragm control valve 21 is divided into a vacuum operating chamber 23 and an atmospheric pressure chamber 24. The atmospheric pressure chamber 24 is equipped with ports 25 and 26, in addition to a port 27 which communicates with the atmosphere, so that the pressure in the atmospheric pressure chamber 24 is maintained at atmospheric pressure. Provided in port 26 is an orifice 28 having an open cross-sectional area Q2. Valve 21 includes a valve body 29 coupled to diaphragm 22 at one end, while the other end of the valve body 29 is provided with a seal member 30. On the side of the diaphragm opposite to valve body 29, there is provided a coil spring 31 which is adapted to maintain the diaphragm 22 in its neutral position. When a vacuum of a level lower than a given level V1 is applied to the vacuum operating chamber 23, the diaphragm 22 is maintained in its neutral position by means of coil spring 31, and valve body 29 intimately contacts or closes the port 26. On the other hand, when a vacuum of a level over a given level V1 is applied to vacuum operating chamber 23, then diaphragm 22 is deflected upward against the action of coil spring 31, so that valve body 29 is detached from port 26. The vacuum operating chamber 23 is connected to a port 32 provided in the wall of the intake manifold 5. The aforesaid given vacuum level V1 may be an intake manifold vacuum, during the deceleration of the engine, which is greater than the intake manifold vacuum during engine idling.

In operation of the first embodiment of the present invention, when the internal combustion engine decelerates, throttle valve 4 is in its idle position, so that the vacuum prevailing in the intake manifold 5 exceeds given level V1. Accordingly, a vacuum of a level higher than given vacuum level V1 is applied through port 32 to the vacuum operating chamber 23 in vacuum responsive diaphragm control valve 21. As a result, diaphragm 22 is deflected upward against the action of the coil spring 31, i.e., toward vacuum operating chamber 23, so that valve body 29 is detached from port 26, thereby opening the passage 19. Thus, outlet 14 in the charcoal canister 11 is brought into communication with a vacuum source or intake manifold 5. As a result, gasoline vapor is flushed out of canister 11 by means of the air entering through atmospheric pressure port 15 and then supplied by way of passage 19, through the purge port 17, to engine 6. The orifice 28, having an open cross-sectional area Q2 restricts the flow rate of gasoline vapor flowing through passage 19 up to a given level and also prevents afterfiring in exhaust manifold 7. At this time, purge port 16 is maintained at atmospheric pressure, so that gasoline vapor will not be supplied through purge port 16 to the internal combustion engine 6.

During idling of internal combustion engine 6, or when throttle valve 4 is opened to an opening smaller than a given opening i.e., when engine 6 is loaded below a given load level, a vacuum in the intake manifold 5 remains below given vacuum level V1, while the pressure at the purge port 16 is maintained substantially at atmospheric pressure. Accordingly, the vacuum responsive diaphragm control valve 21 closes passage 19, and outlet 14 in the charcoal canister 11 does not communicate with the vacuum source, so that gasoline vapor will not be supplied from charcoal canister 11 to the internal combustion engine 6.

When throttle valve 4 is opened to an opening larger than given opening A, i.e., when engine 6 is loaded over a given load level, the vacuum in the intake manifold 5 remains below given vacuum level V1, and a vacuum prevails at the purge port 16. Accordingly, passage 19 is closed by the vacuum responsive diaphragm control valve 21, so that gasoline vapor will not be supplied through the purge port 17 to the engine 6, while the other passage 18 communicates with a vacuum source at the other end, at purge port 16. As a result, gasoline vapor is drawn from charcoal canister 11 by way of passage 18 through purge port 16 into the internal combustion engine 6. Orifice 33, having an open cross-sectional area Q1, restricts the flow rate of gasoline vapor passing through purge passage 18.

Figure 2:
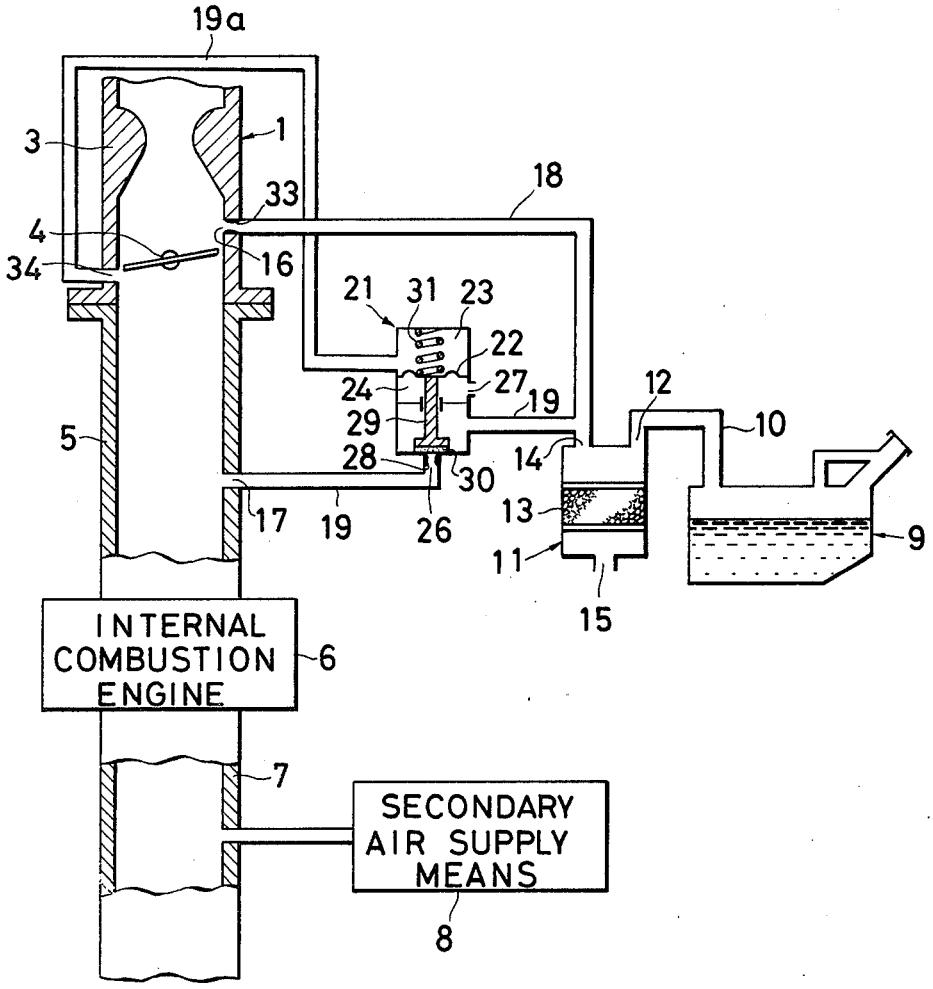

FIG. 2 shows the second embodiment of the fuel evaporation system according to the present invention. Like parts are designated by like reference numerals in common with those given in FIG. 1.

The only difference between the embodiment of FIG. 2 and that of FIG. 1 is that the vacuum operating chamber 31 in vacuum responsive diaphragm control valve 21 is connected by means of passage 34*a* to a port 34 in the wall of the intake passage in close proximity to the throttle valve 4 of carburetor 1. Throttle valve 4 is so designed that, when it is at idling opening, it will assume an upstream position relative to port 34, and when throttle valve 4 is at an opening larger than the idling opening, it will assume a downstream position relative to port 34.

The function of the second embodiment shown in FIG. 2 is the same as that of the first embodiment shown in FIG. 1. In other words, during engine deceleration, a vacuum higher than given vacuum level V1 is applied through port 34 to vacuum operating chamber 31 in the vacuum responsive diaphragm control valve 21, so that gasoline vapor is supplied by way of passage 19 through purge port 17 to the internal combustion engine 6. When the throttle valve 4 is opened to an opening larger than an idling opening, but smaller than given opening A, then a minimum of gasoline vapor is supplied to the engine. When throttle valve 4 is opened to an opening larger than given opening A, then gasoline vapor is supplied by way of the passage 18 through the purge port 16 to the engine 6.

The level of the intake manifold vacuum downstream from throttle valve 4 in general depends not only on the throttle opening but also on the rotational speed of the engine. In the first embodiment of the invention, the deceleration condition of the engine is detected by means of the intake manifold vacuum level. As a result, when the rotational speed of the engine is high, despite the fact that the throttle opening is not at an idling opening, i.e., despite the fact that the engine is not being decelerated, the intake manifold vacuum exceeds a given vacuum level, with the result that the passage 19 is opened. In contrast thereto, according to the second embodiment, when the throttle opening is not at an idling opening, throttle valve 4 assumes a downstream position relative to the port 34, so that atmospheric pressure is supplied to the vacuum operating chamber 31 in the vacuum responsive diaphragm control valve 21, thereby preventing the malfunctioning of vacuum responsive diaphragm control valve 21.

Figure 3:
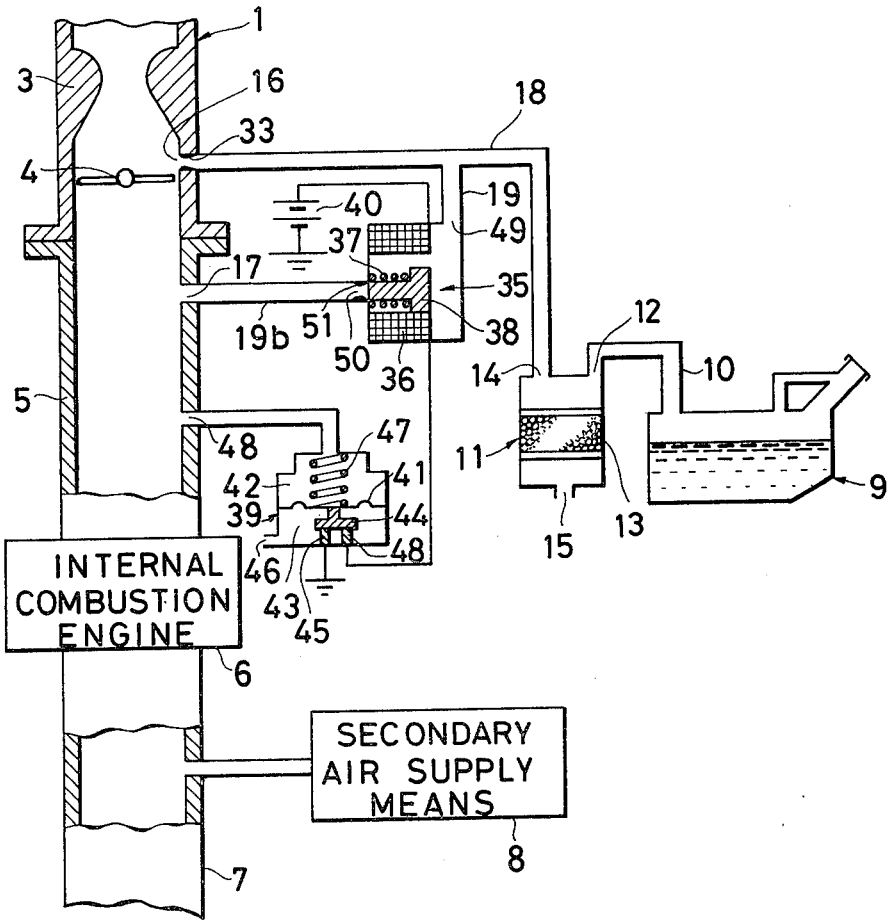

FIG. 3 shows the third embodiment of the fuel evaporation control system according to the present invention. In this embodiment, like parts are again designated by like reference numerals, in common with those given in FIG. 1. An electromagnetic valve 35 is provided midway in passage 19 for opening and closing the passage. Electromagnetic valve 35 is equipped with ports 49 and 50 which communicate with passages 19 and 19b, respectively. Solenoid 36 and plunger 38 serve as the valve body. An orifice 51 having an open cross-sectional area Q2 is provided in port 50. Coil spring 37 is provided in valve 35 so as to maintain plunger 38 in its neutral position, i.e., to keep plunger 38 away from port 50. When solenoid 36 is energized, plunger 38 is attracted toward the solenoid 36 and closes port 50. On the other hand, when solenoid 36 is de-energized, plunger 38 is pushed away from port 50 by the action of spring 37. A vacuum responsive switch 39 is provided which comprises a vacuum operating chamber 42 and an atmospheric pressure chamber 43 which are partitioned by diaphragm 41. The atmospheric pressure chamber 43 communicates by way of port 46 with the atmosphere. A coil spring 47 is provided in switch 39 so as to maintain diaphragm 41 in its neutral position. The diaphragm 41 has a contact element 44 attached thereto, which is adapted to bridge and connect terminals 45 and 48. When a vacuum lower than given vacuum level V1 is applied to the vacuum operating chamber 42, diaphragm 41 is maintained in its neutral position under the action of coil spring 47, and the contact element 44 contacts terminals 45 and 48. On the other hand, when a vacuum over given vacuum level V1 is applied to vacuum operating chamber 42, diaphragm 41 is deflected against the action of the coil spring 47, whereby contact element 44 is separated from terminals 45 and 48.

The vacuum operating chamber 42 is connected to a port 48 provided in the wall of intake manifold 5. The terminal 45 is grounded, while the terminal 48 is connected to one end of solenoid 36 in electromagnetic valve 35. The other end of solenoid 36 in the electromagnetic valve 35 is connected to a positive pole of direct current power source 40, while the negative pole of the power source 40 is grounded.

When the internal combustion engine 6 is being decelerated, throttle valve 4 assumes a downstream position relative to purge port 16, while an intake manifold vacuum exceeds given vacuum level V1. Accordingly, the contact element 44 of vacuum switch 39 is separated from terminals 45 and 48. Since the solenoid 36 in electromagnetic valve 35 is de-energized, plunger 38 is separated from the port 50. Thus, gasoline vapor is supplied from charcoal canister 11 through passage 19 and purge port 17 to internal combustion engine 6.

During engine idling or when the throttle valve 4 is opened to an opening smaller than given opening A, the throttle valve assumes a downstream position relative to purge port 16, and the intake manifold vacuum remains below given vacuum level V1. Accordingly, contact element 44 in the vacuum switch 39 contacts the terminals 45 and 48, whereby the solenoid 36 in electromagnetic valve 35 is energized. This causes the plunger 38 to be pulled toward port 50 against the action of coil spring 37 to close part 50. At this time, purge port 16 is maintained at atmospheric pressure, while the passage 19 is closed by electromagnetic valve 35, so that gasoline vapor will not be supplied from charcoal canister 11 to the internal combustion engine.

When throttle valve 4 is opened to an opening larger than a given valve, throttle valve 4 assumes an upstream position relative to purge port 16, while the intake manifold vacuum remains below given vacuum level V1. As a result, contact element 44 of vacuum switch 39 contacts terminals 45 and 48, as in the case where the opening of throttle valve 4 is smaller than given opening A. Although the passage 19 is thereby closed, gasoline vapor may be supplied from charcoal canister 11 by way of the passage 18 through the purge point 16 to internal combustion engine 6.

Figure 4:
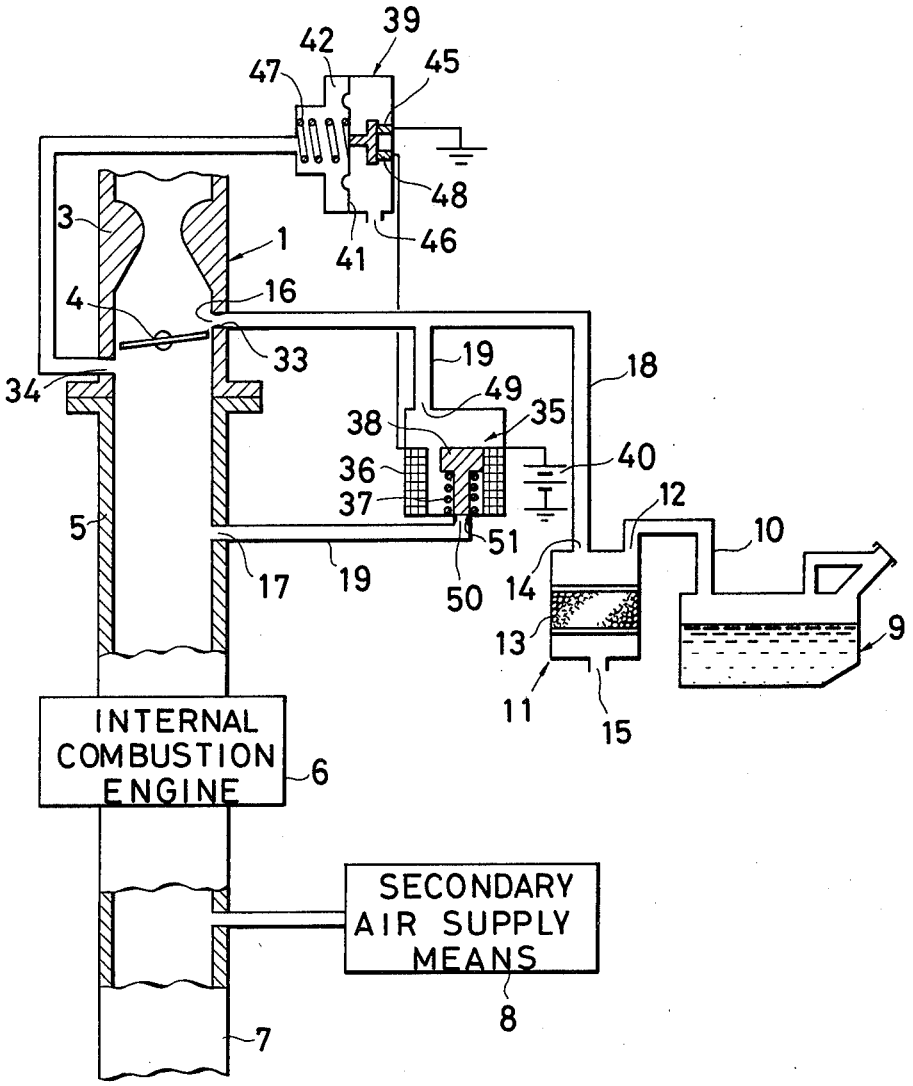

FIG. 4 shows the fourth embodiment of the fuel evaporation control system according to the present invention. In this embodiment, like parts are also designated by like reference numerals in common with those given in FIG. 3.

The difference between the respective embodiments shown in FIGS. 3 and 4, is that the vacuum operating chamber 42 in the vacuum switch 39 is connected to the port 34 positioned in close proximity to throttle valve 4 as shown in FIG. 2.

The function of the fourth embodiment with respect to the openings of throttle valve 4 and engine deceleration is the same as that of the third embodiment of FIG. 3.

The advantage of the fourth embodiment over that of the third embodiment is the same as that of the second embodiment. In other words, the vacuum operating chamber 42 in the vacuum switch 39 is connected so as to prevent malfunctioning of the vacuum switch 39.

Figure 5:
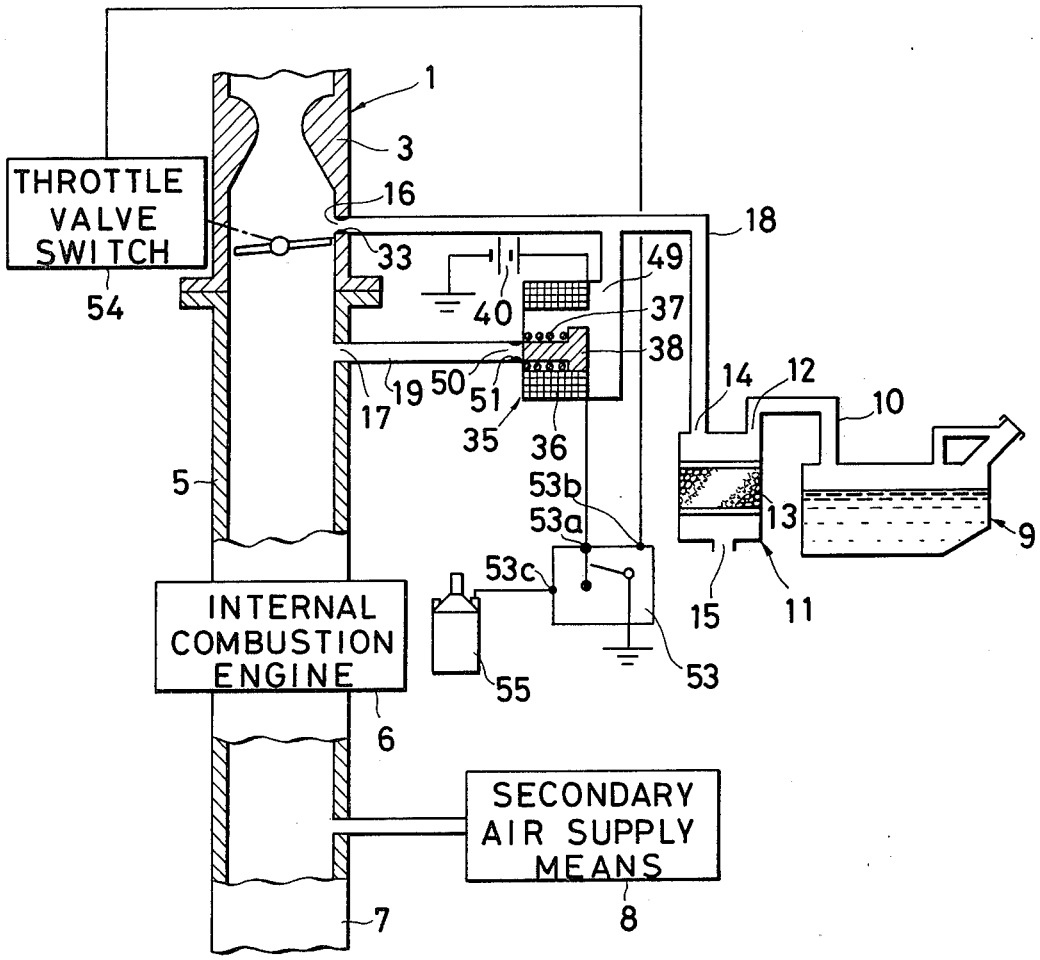

FIG. 5 shows the fifth embodiment of the fuel evaporation control system according to the present invention. Like parts are designated by like reference numerals in common with FIG. 3.

In the embodiment shown in FIG. 5, a computer 53 is used for controlling solenoid 36 in electromagnetic valve 35, in place of vacuum switch 39. One end of solenoid 36 is connected to an output terminal **53*a* of computer 53. Input terminals 53*b* and 53*c* in computer 53 are connected to a throttle valve switch 54 and to the interrupter of the ignition distributor 55 for deriving information associated with the opening of throttle valve 4 and the rotational speed of engine 6, respectively. Thus, when throttle valve 4 is opened to an idling opening and the rotational speed of the engine is higher than idling speed, i.e., during engine deceleration, the output terminal 53*a* of computer 53 is disconnected from the ground. On the other hand, when throttle valve 4 is opened to an opening lager than the idling opening and rotational speed of the engine is at idling speed, the output terminal 53*a* of computer 53** is grounded.

Upon engine deceleration, output terminal **53*a* is disconnected from the ground, so that solenoid 36 in electromagnetic valve 35 is de-energized. As a result, the passage 19 is kept open, and gasoline vapor is supplied from charcoal canister 11 by way of passage 19 through the purge port 17 to internal combustion engine 6. At this time, throttle valve 4 assumes a downstream position relative to purge port 16, so that gasoline vapor is not supplied through the purge port 16 to the engine 6**.

When internal combustion engine 6 is in an idling condition or throttle valve 4 is opened to an opening smaller than given opening A, the throttle valve assumes a downstream position relative to purge port 16, and output terminal **53*a* of the computer 53 is grounded, so that solenoid 36 is energized. Accordingly, gasoline vapor is not supplied through the purge ports 16 and 17 to internal combustion engine 6**.

When throttle valve 4 is opened to an opening larger than given opening A, it assumes an upstream position relative to purge port 16, and the output terminal **53*a* of computer 53 is grounded, so that the solenoid 36 is also grounded. As a result, passage 19 remains closed, and gasoline vapor is supplied to the engine exclusively from charcoal canister 11 by way of passage 18 through purge port 16**.

Figure 6:
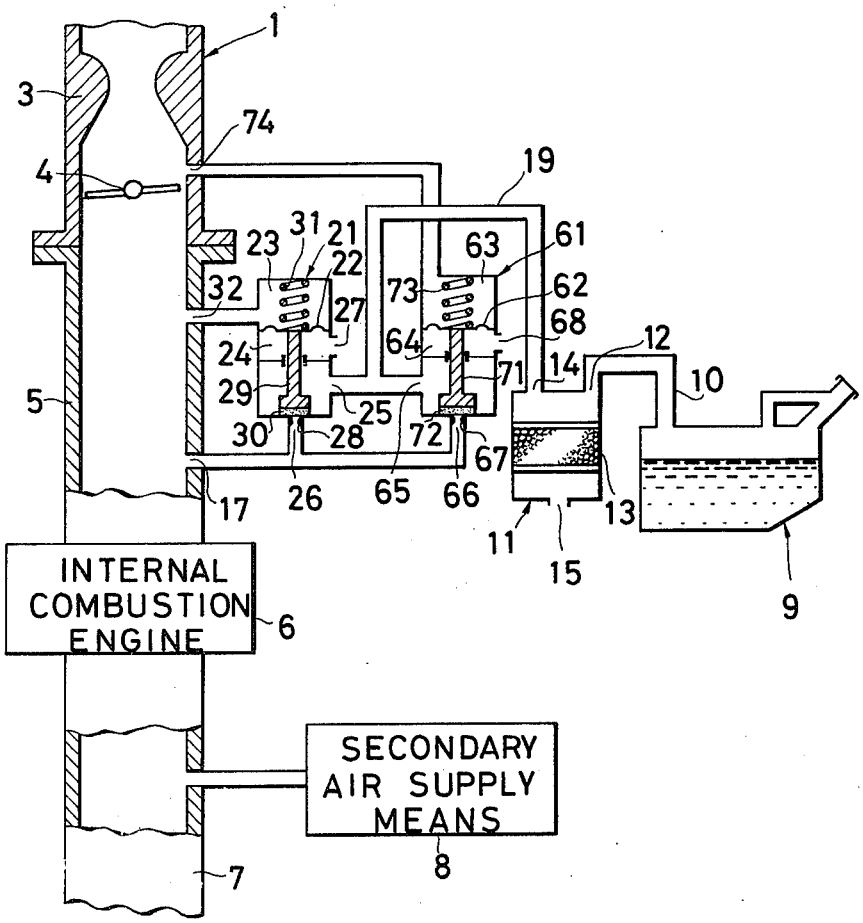

FIG. 6 shows the sixth embodiment of the fuel evaporation control system according to the present invention. As in the previous embodiments, like parts are designated by like reference numerals in common with FIG. 1.

In the embodiment of FIG. 6, there are provided, in parallel relation, a vacuum responsive diaphragm control valve 61 and another vacuum responsive diaphragm control valve 21. The vacuum responsive diaphragm control valve 61 is of the same construction as that of valve 21. More particularly, the vacuum responsive diaphragm control valve 61 includes a vacuum operating chamber 63, an atmospheric pressure chamber 64 partitioned from chamber 63 by diaphragm 62, and ports 65 and 66. An orifice 67 having an open cross-sectional area Q1 is provided in the port 66. The atmospheric pressure chamber 63 is provided with a port 68 which communicates with the atmosphere, whereby the pressure therein is maintained at atmospheric pressure. A valve body 71 is coupled to diaphragm 62 at one end, while the other end of the valve body is provided with a sealing member 72. A coil spring 73 is placed in valve 61 in contact with diaphragm 62 so as to maintain the diaphragm in its neutral position. When a vacuum greater than a given vacuum level V2 ($V2<V1$) is supplied to the vacuum operating chamber 63 in the vaccum responsive diaphragm control valve 61, the diaphragm 62 is deflected against the action of coil spring 73, so that valve body 71 is separated from port 66. On the other hand, when a vacuum approximating atmospheric pressure, i.e., lower than the given vacuum level V2 is supplied to vacuum operating chamber 63, the valve body 71 is urged toward port 66 to close the latter. A port 74 is provided in the wall of the intake passage in close proximity to throttle valve 4 of carburetor 1. The position of port 74 is the same as that of purge port 16 of FIG. 1. Stated differently, when throttle valve 4 is opened to an opening smaller than given opening A, throttle valve 4 assumes a downstream position relative to port 74. On the other hand, when throttle valve 4 is opened to an opening larger than the given opening A, then throttle valve 4 assumes an upstream position relative to port 74. The vacuum operating chamber 63 in vacuum responsive diaphragm control valve 61 is connected to port 74.

During engine deceleration, the intake manifold vacuum is above given level V1, and throttle valve 4 assumes a downstream position relative to port 74. Accordingly, a vacuum greater than the given level V1 is supplied through port 32 to vacuum operating chamber 23 in vacuum responsive diaphragm control valve 21, while a vacuum approximating atmospheric pressure is supplied to the vacuum operating chamber 63 in the vacuum responsive diaphragm control valve 61. In addition, valve body 29 is separated from port 26, while valve body 71 closes port 66. Thus, gasoline vapor is supplied from charcoal canister 11 through ports 25 and 26 in the vacuum responsive diaphragm control valve 21 and then through purge port 17 to the internal combustion engine.

When the engine 6 is in an idling condition, or when throttle valve 4 is opened to an opening larger than given opening A, the intake manifold vacuum remains below given vacuum level V1, and the throttle valve 4 assumes a downstream position relative to port 74. Accordingly, a vacuum lower than given vacuum level V1 is supplied to the vacuum operating chamber 23 in the vacuum responsive diaphragm control valve 21, while a vacuum approximating atmospheric pressure is supplied to the vacuum operating chamber 63 in the vacuum responsive diaphragm control valve 61. The valves 29 and 71 both close ports 26 and 66. Thus, gasoline vapor is not supplied from the charcoal canister 11 to the engine.

When throttle valve 4 is opened to an opening larger than the given opening A, throttle valve 4 assumes an upstream position relative to port 74, and the level of the vacuum prevailing in the intake system downstream from the throttle valve 4 remains lower than the given vacuum level V1, but above the level V2. As a result, valve body 29 in the vacuum responsive diaphragm control valve 21 contacts port 26 to close the latter, while the valve body 71 in vacuum responsive diaphragm control valve 61 is separated from port 66. Thus, gasoline vapor flows through ports 65 and 66 in vacuum responsive diaphragm control valve 61 and then through purge port 17 to the internal combustion engine 6.

Figure 7:
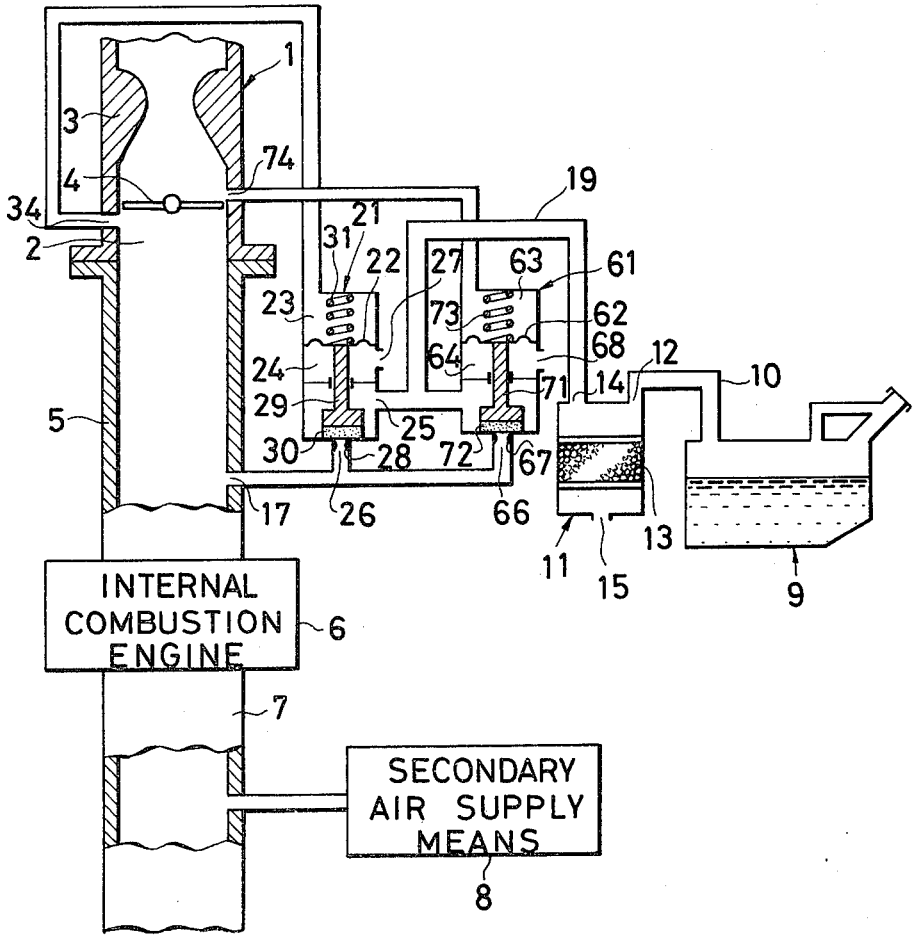

FIG. 7 shows the seventh embodiment of the fuel evaporation control system according to the present invention, which is a modification of the embodiment of FIG. 6. Like parts are designated by like reference numerals in common with those given in FIG. 6.

In the embodiment of FIG. 7, vacuum operating chamber 23 in vacuum responsive diaphragm control valve 21 is connected to port 34 provided in the wall of the intake in close proximity to throttle valve 4, as in the case of the embodiment of FIG. 2.

The advantage of the embodiment of FIG. 7 over that of FIG. 6 is that it prevents the mal-functioning of vacuum responsive diaphragm control valve 57, as in the case of the embodiment of FIG. 2.

Figure 8:
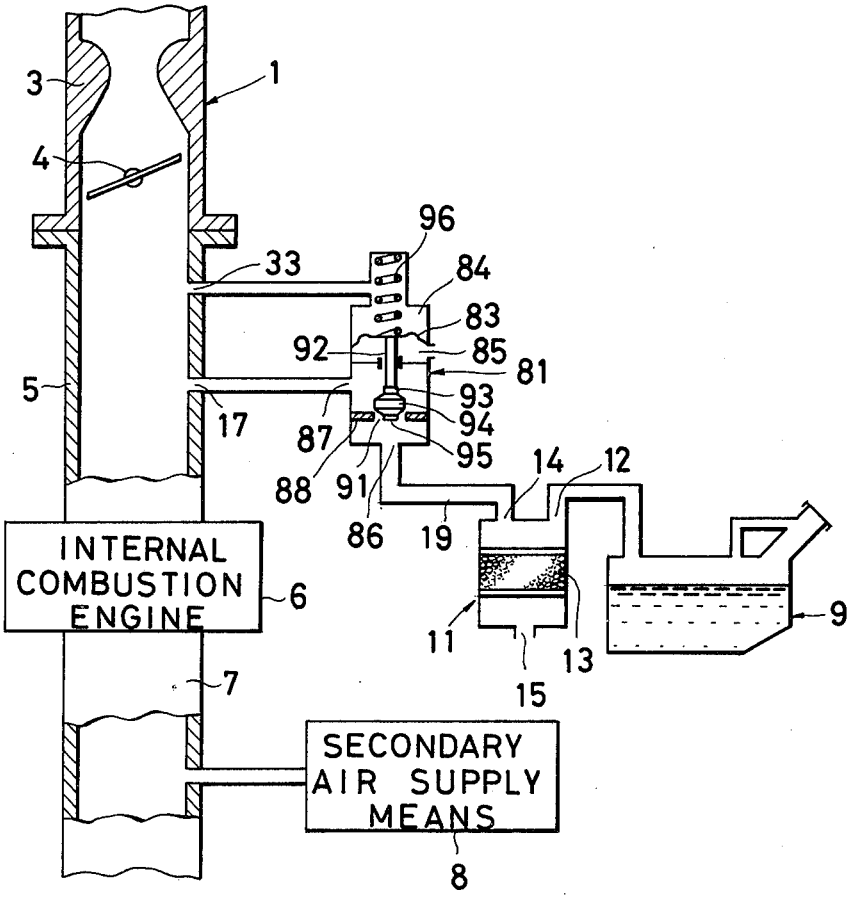

FIG. 8 shows the eighth embodiment of the fuel evaporation control system according to the present invention. In this case like parts are also designated by like reference numerals in common with those given in FIG. 1.

A vacuum responsive diaphragm control valve 81 includes a vacuum operating chamber 84 and an atmospheric pressure chamber 85 which are separated by a diaphragm 83. The atmospheric pressure chamber 85 is maintained at atmospheric pressure at all times. The vacuum responsive diaphragm control valve 81 is equipped with ports 86 and 87. A partition wall 88 is provided in valve 81 between the ports 86 and 87, with a circular hole 91 provided at its center. A valve body 92, coupled to diaphragm 83, is formed with a portion having varying diameters, 93, 94, and 95, as viewed from the side of the diaphragm 83. The diameter of the portion 94 is larger than that of portions 93 and 95 and is substantially equal to the diameter of the hole 91 in partition wall 88. The valve body 92 enters into or is withdrawn from hole 91 in response to deflection of the diaphragm 83. A coil spring 96 urges the diaphragm 83 towards atmospheric pressure chamber 85.

In vacuum responsive diaphragm control valve 81, the vacuum operating chamber 84 is connected to port 33, while port 86 is connected to outlet 14 in the charcoal canister 11. Port 87 is connected to the aforesaid port 17.

During engine deceleration, the intake manifold vacuum remains above a given vacuum level, so that diaphragm 83 is substantially deflected toward vacuum operating chamber 84. As a result, as shown in FIG. 8, the portion 95 of valve body 92 is positioned in the hole 91, so that gasoline vapor is supplied through purge port 17 to the internal combustion engine 6 through a clearance between the periphery of hole 91 and the portion 95.

Figure 9:
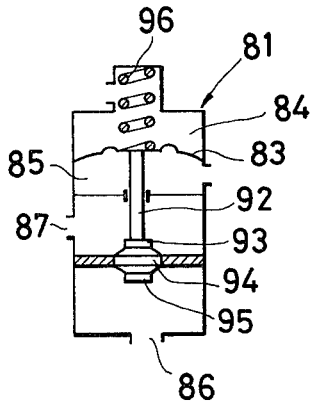
FIGS. 9 and 10 are cross-sectional views of a vacuum responsive or operated diaphragm control valve used in FIG. 8.

During engine idling, or when the throttle valve opening is larger than a given opening, the intake manifold vacuum is lower than given vacuum level V1 but above given vacuum level V2, as was described earlier with reference to the embodiment of FIG. 6. Furthermore, the intake manifold vacuum remains lower than the given vacuum level V1 and above the given vacuum level V2. As shown in FIG. 9, the extent of deflection of the diaphragm 83 in vacuum responsive diaphragm control valve 81 is relatively small, so that the portion 94 of valve body 92 is positioned in hole 91. At this time, there is little or no clearance between the periphery of hole 91 and the portion 94, so that gasoline vapor is not supplied from charcoal canister 11 through the purge port 17 to engine 6.

Figure 10:
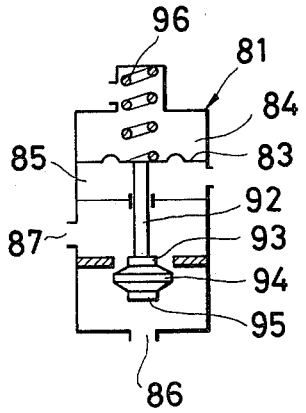

When the throttle valve opening is such that it results in a vacuum over the given vacuum level A, the intake manifold vacuum remains lower than given vacuum level V2. Accordingly, as shown in FIG. 10, diaphragm 83 in the vacuum responsive diaphragm control valve 81 is maintained in its neutral position, so that the portion 93 of the valve body 92 is positioned in the hole 91. Thus, gasoline vapor is supplied through the clearance between the periphery of the hole 91 and the portion 93 through the purge port 17 to the internal combustion engine 6.

Figure 11:
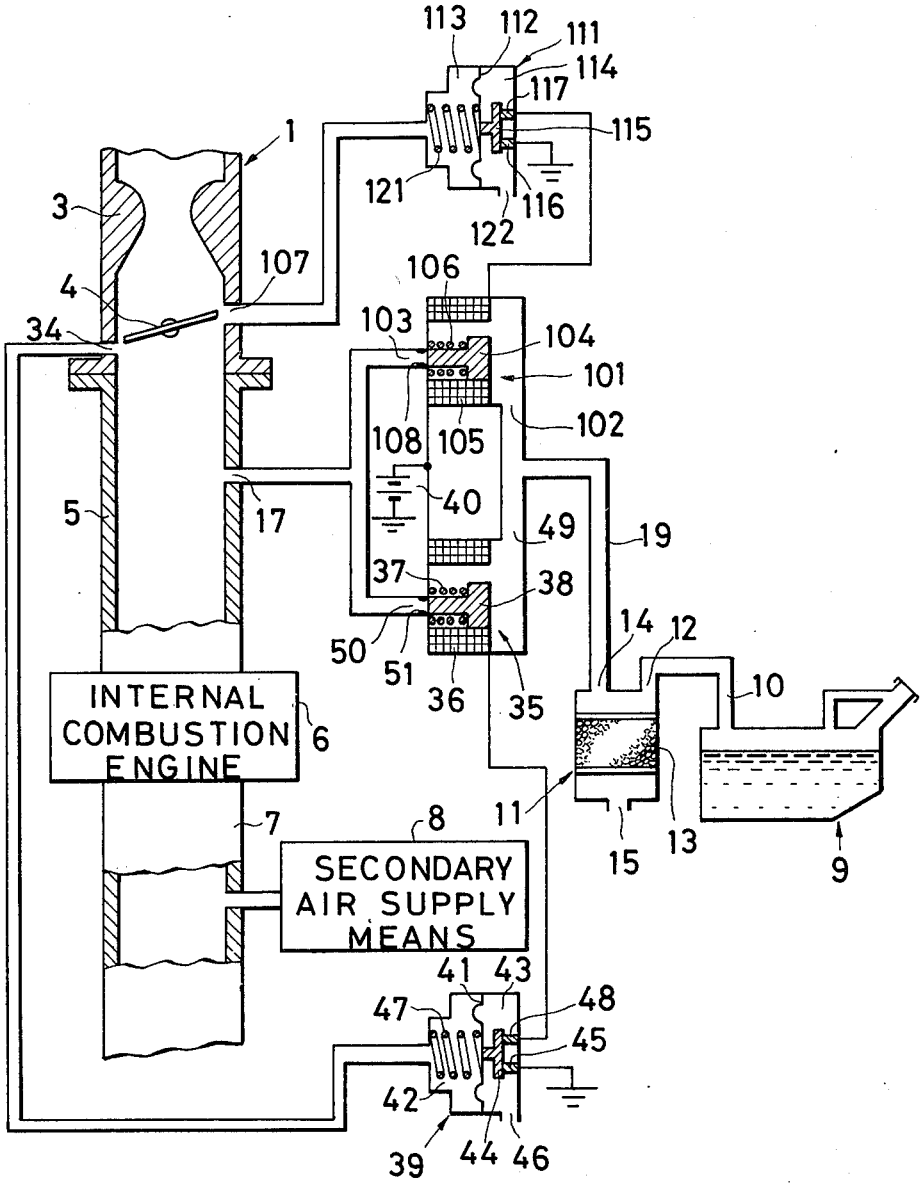

FIG. 11, the ninth embodiment, is a modification of the embodiment of FIG. 4. Like parts are again designated like reference numerals in common with those given in FIG. 4.

In the embodiment of FIG. 4, when the internal combustion engine 6 is loaded above a given load level, gasoline vapor is supplied from charcoal canister 11 through purge port 16 to the engine. In contrast thereto, according to the embodiment of FIG. 11, gasoline vapor is supplied from charcoal canister 11 to the engine through purge port 17 provided in the wall of the intake manifold 5.

An electromagnetic valve 101 having the same construction as that of electromagnetic valve 35 is positioned in parallel with the electromagnetic valve 35. Electromagnetic valve 101 includes ports 102 and 103, plunger 104 serving as a valve body, a solenoid 105 adapted to attract plunger 104, and a coil spring 106 for maintaining the plunger 104 in its neutral position. An orifice 108 having an open cross-sectional area Q1 is provided in port 103. When the solenoid 105 is energized, the plunger 104 is forced towards the port 103 to close the latter. When solenoid 105 is deenergized, plunger 104 is separated from the port so as to open the latter. A port 107 is provided in the wall of the intake passage 5 in close proximity to throttle valve 4. When the throttle valve is opened to an opening larger than given opening A, it assumes an upstream position relative to the port 107. When the throttle valve is opened to an opening smaller than given opening A, it assumes a downstream position relative to the port 107.

A vacuum switch 111, of the same construction as vacuum switch 39, includes a vacuum operating chamber 113 and an atmospheric pressure chamber 114, which are separated by diaphragm 112, a contact element 115 coupled to diaphragm 112, and terminals 115 and 117. A coil spring 121 is provided in valve 111 so as to maintain the diaphragm 112 in its neutral position. Atmospheric pressure chamber 114 is provided with a port 122 open to the atmosphere. When a vacuum greater than a given vacuum level is applied to the vacuum operating chamber 113, diaphragm 112 is deflected against the action of the coil spring 121, so that the contact element 115 is separated from the terminals 116 and 117. When a vacuum approximating atmospheric pressure, i.e., a vacuum lower than given vacuum level V2 is supplied to vacuum operating chamber 113, diaphragm 112 is maintained in its neutral position under the action of coil spring 121, so that the contact element 115 contacts both the terminal 115 and 117.

Port 107 is connected to vacuum operating chamber 113. Port 102 in the electromagnetic valve 101 is connected to outlet 14 of the charcoal canister 11, while port 103 in valve 101 is connected to purge port 17. Terminal 116 in vacuum switch 111 is grounded, and terminal 117 is connected to one end of solenoid 105 in electromagnetic valve 101. The other end of the solenoid 105 in the electromagnetic valve 101 is connected to a positive pole of a direct current power source 40.

During engine deceleration, throttle valve 4 assumes a downstream position relative to port 107, and an upstream position relative to port 34, so that the intake manifold vacuum downstream of the throttle valve remains above given vacuum level V1. As a result, terminals 116 and 117 in vacuum switch 11 are connected by contact element 115, while terminal 45 is disconnected from terminal 48 in vacuum switch 39. Solenoid 105 in electromagnetic valve 101 is energized, so that plunger 104 is forced toward port 103 to close the same, while plunger 38 in electromagnetic valve 35 is separated from port 50 under the action of coil spring 37. Thus, gasoline vapor is supplied to engine 6 through purge port 17 from the charcoal canister by way of ports 49 and 50 in electromagnetic valve 35.

When the internal combustion engine 6 is idling, the positional relationship of throttle valve 4 to the ports 34, and 107 is the same as in the case of engine deceleration. However, an intake manifold vacuum downstream from throttle valve 4 is lower than given vacuum level V1. Accordingly, as in the vacuum switch 111, contact element 44 connects terminals 45 and 48 in the vacuum switch 48. The solenoid 36 in the electromagnetic valve 35 is energized, so that the plunger 38 is forced towards the port 50 so as to close the same. On the other hand, the solenoid 105 in the electromagnetic valve 101 is energized as in the case of deceleration of the internal combustion engine 6. Under these conditions, gasoline vapor is not supplied from the charcoal canister 11 to the engine 6.

When throttle valve 4 is opened to an opening larger than an idling opening, but smaller than given opening A, the valve assumes a downstream position relative to ports 34 and 107. Accordingly, a vacuum approximating atmospheric pressure is supplied to the vacuum operating chambers 42 and 113 in vacuum switches 39 and 111, respectively, so that contact 44 is connected to contact 48, while the contact 116 is connected to the contact 117. Solenoids 36 and 105 are both energized, as when the engine 6 is idling, so that gasoline vapor is not supplied from the charcoal canister 11 to the engine 6.

When throttle valve 4 is opened to an opening larger than given opening A, it assumes a downstream position relative to port 34, but an upstream position relative to the port 107. Accordingly, a vacuum above given vacuum level V2 is supplied to vacuum operating chamber 113 in vacuum switch 111, so that contact element 115 is separated from terminals 116 and 117. Solenoid 105 in electromagnetic valve 101 is there de-energized, and plunger 104 is separated from port 103 under the action of the coil spring 106. Thus, gasoline vapor is supplied to engine 6 through ports 102 and 103, and then through purge port 17.

Figure 12:
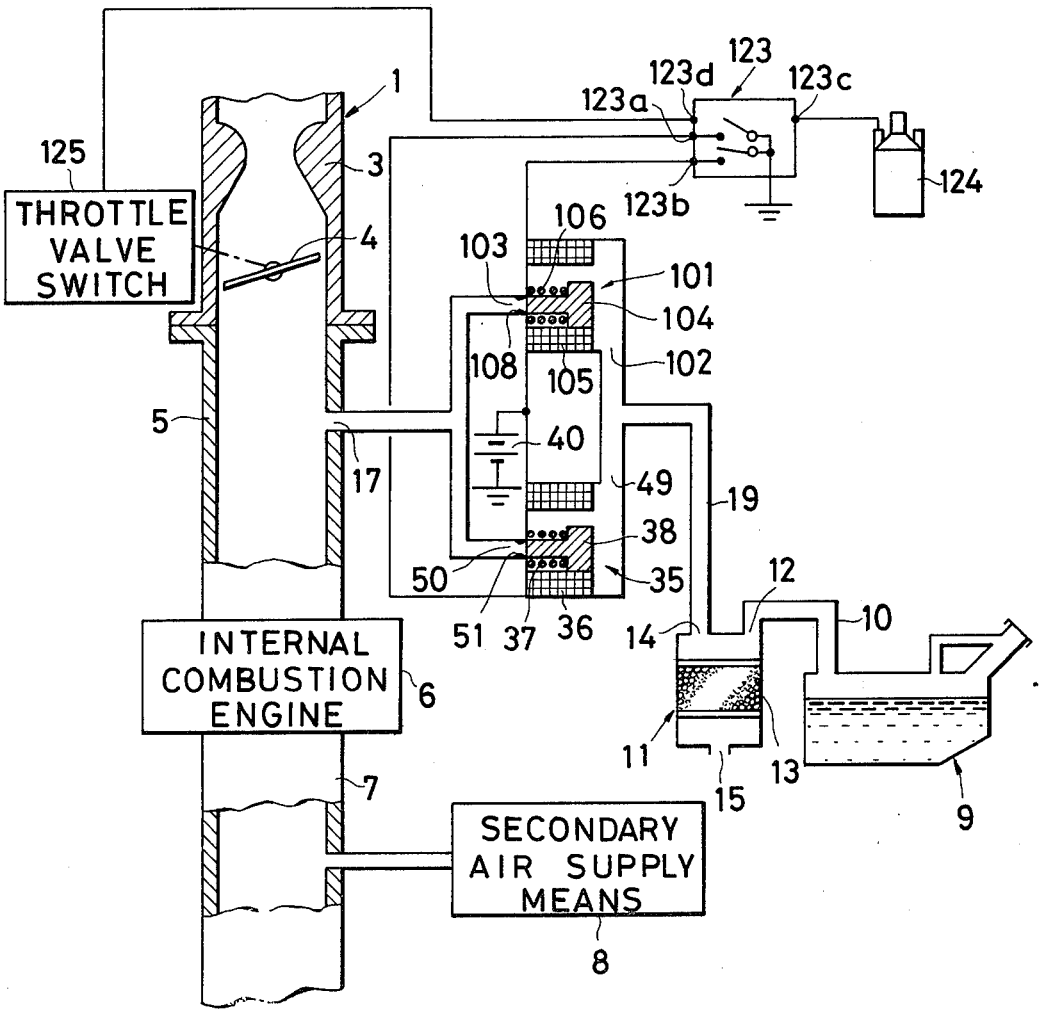

FIG. 12 is the tenth embodiment of the fuel evaporation control system according to the present invention. This embodiment is a modification of the embodiment of FIG. 11. In this embodiment, as well, like parts are designated by like reference numerals in common with those given in FIG. 11.

In the embodiment of FIG. 12, a computer 123 is used for operating solenoids 36 and 105 in electromagnetic valves 35 and 101, in place of a vacuum switch.

The terminals of solenoids 36 and 105 in electromagnetic valves 35 and 101 are connected to the output terminals 123*a* and 123*b* of the computer 123, respectively. Output terminals 123*c* and 123*d* of computer 123 are connected to the interrupter of ignition distributer 124 and to throttle switch 125, respectively. When the throttle valve is at an idling opening and the rotational speed of the engine is higher than the idling speed, i.e., during engine deceleration, input terminal 123*a* of the computer 123 is grounded, while the input terminal 123*b* is disconnected from the ground. On the other hand, when throttle valve 4 is opened to an opening larger than a idling opening and the rotational speed of the engine is lower than a given value, i.e., when the engine is loaded below a given load level, the input terminals 123*a* and 123*b* are both disconnected from the ground. Furthermore, when throttle valve 4 is opened to an opening larger than an idling opening and the rotational speed of the engine is above a given value, i.e., when the engine is loaded above a given load level, input terminal 123*a* of computer 123 is disconnected from the ground, while input terminal 123*b* is grounded.

As in the embodiment of FIG. 11, in the embodiment of FIG. 12, solenoids 36 and 105 in electromagnetic valves 35 and 101 are energized or de-energized, and gasoline vapor is supplied to the engine from charcoal canister 11, by way of valves 3, 5 or 101 through purge port 17 in response to the condition of the engine.

As is apparent from the foregoing description of the fuel evaporation control systems according to the present invention, when an oxygen concentration in the exhaust gases is high, i.e., even during engine deceleration, gasoline vapor may be supplied from the charcoal canister to the internal combustion engine. Thus, the time required to flush gasoline vapor with air flowing through the canister may be shortened when the engine is loaded above a given load level, without increasing the amount of harmful constituents of the exhaust gases, thus improving the efficiency of the canister.

While the present invention has been described herein with reference to certain exemplary embodiments thereof, it should be understood that various changes, modifications, and alterations may be made without departing from the spirit and the scope of the present invention, and that said invention is not limited except as defined in the appended claims.

What is claimed is:

1. A fuel evaporation control system for use in an internal combustion engine, comprising:

(a) a fuel tank;

(b) a charcoal canister connected to said fuel tank containing activated charcoal for adsorbing gasoline vapor from said fuel;

(c) a carburetor connected by an intake passage to an intake manifold and having a purge port in said intake passage;

(d) a throttle valve in said intake passageway located in close proximity to said purge port, said port being so located that said throttle valve will assume an upstream position or a downstream position relative to said purge port, depending on the open position of said throttle valve;

(e) a first vacuum responsive valve including means defining a first vacuum operating chamber and means defining a first atmospheric pressure chamber communicating with the atmosphere;

(f) a diaphragm separating said chambers, said first vacuum operating chamber including resilient means therein for maintaining said diaphragm in its neutral position and further including a port communicating with a port in said intake manifold at a position downstream from said throttle valve, said first atmospheric pressure chamber including a valve body coupled to said diaphragm and having a first port communicating with the atmosphere, a second port connected to said intake manifold further downstream from said throttle valve than said first vacuum operating chamber and adapted to be opened or closed by said valve body, and a third port connected to said charcoal canister, said first port being shut off by a partition wall from communication with said second and third ports;

(g) a second vacuum responsive valve including means defining a second vacuum operating chamber and means defining a second atmospheric pressure chamber communicating with the atmosphere; and (h) a diaphragm separating said chambers, said second vacuum operating chamber including resilient means for maintaining said diaphragm in its neutral position and communicating with the purge port, said purge port being so located that said throttle valve will assume an upstream position or a downstream position relative to said purge port, depending on the open position of said throttle valve, said second atmospheric pressure chamber including a valve body coupled to said diaphragm, said second atmospheric pressure chamber having a first port communicating with the atmosphere, a second port connected to said second port in said first vacuum responsive valve, thereby being connected to said intake manifold, and being adapted to be opened and closed by said valve body, and a third port connected to said third port in said first vacuum responsive valve thereby being connected to said charcoal canister, said first port being shut off by a partition wall from communication with said second and third ports.

2. A fuel evaporation control system for use in an internal combustion engine, comprising:

(a) a fuel tank;

(b) a charcoal canister connected to said fuel tank containing activated charcoal for adsorbing gasoline vapor from said fuel;

(c) a carburetor connected by an intake passage to an intake manifold and having a purge port in said intake passage;

(d) a throttle valve in said intake passageway located in close proximity to said purge port, said port being so located that said throttle valve will assume an upstream position or a downstream position relative to said purge port, depending on the open position of said throttle valve;

(e) a first vacuum responsive valve including means defining a first vacuum operating chamber and means defining a first atmospheric pressure chamber communicating with the atmosphere;

(f) a diaphragm separating said chambers, said first vacuum operating chamber including resilient means therein for maintaining said diaphragm in its neutral position and further including a port communicating with a port opening into said intake passage in close proximity to said throttle valve, said port in the intake passage being so located that said throttle valve will assume a downstream position relative to said port when said throttle valve is not in an idling opening, thereby allowing the pressure in said first vacuum operating chamber to become atmospheric, said first atmospheric pressure chamber including a valve body coupled to said diaphragm and having a first port communicating with the atmosphere, a second port connected to said intake manifold further downstream from said throttle valve than said first vacuum operating chamber and adapted to be opened or closed by said valve body, and a third port connected to said charcoal canister, said first port being shut off by a partition wall from communication with said second and third ports;

(g) a second vacuum responsive valve including means defining a second vacuum operating chamber and means defining a second atmospheric pressure chamber communicating with the atmosphere; and (h) a diaphragm separating said chambers, said second vacuum operating chamber including resilient means for maintaining said diaphragm in its neutral position and communicating with the purge port, said purge port being so located that said throttle valve will assume an upstream position or a downstream position relative to said purge port, depending on the open position of said throttle valve, said second atmospheric pressure chamber including a valve body coupled to said diaphragm, said second atmospheric pressure chamber having a first port communicating with the atmosphere, a second port connected to said second port in said first vacuum responsive valve, thereby being connected to said intake manifold, and being adapted to be opened and closed by said valve body, and a third port connected to said third port in said first vacuum responsive valve thereby being connected to said charcoal canister, said first port being shut off by a partition wall from communication with said second and third ports.

* * * * *